US006877421B2

(12) United States Patent
Rexhaj

(10) Patent No.: US 6,877,421 B2
(45) Date of Patent: Apr. 12, 2005

(54) DEVICE FOR BINDING OF PULP BALES

(75) Inventor: Fahredin Rexhaj, Sundsbruk (SE)

(73) Assignee: Metso Paper, Inc. (SE)

( * ) Notice: Subject to any disclaimer, the term of this patent is extended or adjusted under 35 U.S.C. 154(b) by 0 days.

(21) Appl. No.: 10/024,908

(22) Filed: Dec. 19, 2001

(65) Prior Publication Data

US 2002/0162463 A1 Nov. 7, 2002

(30) Foreign Application Priority Data

Dec. 21, 2000 (SE) ..... 0004821

(51) Int. Cl.[7] ..... B65B 13/04

(52) U.S. Cl. ..... 100/26; 100/29; 100/32; 53/589

(58) Field of Search ..... 100/26, 31, 32, 100/33 R, 29, 33 PB; 53/399, 589

(56) References Cited

U.S. PATENT DOCUMENTS 3,157,109 A 11/1964 Flanigan et al.
3,929,063 A 12/1975 Stromberg et al.
4,177,724 A * 12/1979 Johnson et al. ..... 100/26
5,177,446 A 1/1993 Boriani et al.
5,299,407 A 4/1994 Schuttler et al.
5,551,218 A 9/1996 Henderson et al.
5,746,120 A 5/1998 Jonsson
5,823,103 A * 10/1998 Kuei ..... 100/4
6,195,967 B1 3/2001 Todd et al.

FOREIGN PATENT DOCUMENTS

GB 1 388 385 4/1972
SE 380496 B 11/1975
SE 509532 C2 2/1999
SE 509534 C2 2/1999

* cited by examiner

*Primary Examiner*—Allen Ostrager
*Assistant Examiner*—Jimmy T Nguyen
(74) *Attorney, Agent, or Firm*—Lerner, David, Littenberg, Krumholz & Mentlik, LLP

(57) ABSTRACT

A binding device for binding pulp bales with wire drawn from a wire magazine is disclosed including a feed for feeding and tightening the wire, a guide for guiding the wire around the bale during forward feeding thereof, a processor for cutting the tightened wire and twisting together the ends thereof, and a take-up unit for taking up the slack loop of wire arising from the tightening of the wire. A spring-loaded device adjacent to the feed means dampens the jerk which occurs when the slack loop of wire runs out and wire begins to be drawn from the magazine.

16 Claims, 3 Drawing Sheets

DEVICE FOR BINDING OF PULP BALES

FIELD OF THE INVENTION

The present invention relates to apparatus for binding pulp bales with wire drawn from a wire magazine, preferably a reel of wire. More particularly, the present invention relates to such apparatus including means for feeding and tightening the wire, guide means for guiding the wire around the object (bale) during forward feeding, means for cutting the tightened wire and holding and twisting together the ends thereof, and a take-up unit for taking up the slack loop that arises when the wire is tightened.

BACKGROUND OF THE INVENTION

Pulp bales are bound by means of known devices of the aforementioned type, examples of such devices being disclosed in Swedish Patent Nos. 380,496; 509,532; and 509,534. As described in these specifications, the free end of the wire is fed forwards through the cutting and twisting means and is guided around the bale by guide means. When the wire end reaches the cutting and twisting means for the second time, feeding is stopped and the wire end is gripped and held. The guide means releases the wire and the feed means is reversed in order to tighten the wire around the bale, whereafter the wire is cut and the ends twisted to form a knot. The reverse fed wire is used in the next binding operation. Known devices have a high noise level and suffer frequent breakdowns due to kinks and tangles in the wire.

It is one object of the present invention to improve the reliability and availability of such apparatus, as well as to reduce the noise level, to reduce the risk of kinks and tangles in the wire, to reduce the mechanical stresses on the device, and to permit a high feed rate of the wire.

SUMMARY OF THE INVENTION

This and other objects have now been realized by the invention of apparatus for binding bales with wire comprising feed means for feeding and tightening the wire, a guide for guiding the wire fed by the feed means around the bale, wire processing means for cutting, tightening and twisting the ends of the wire, a take-up unit for taking up a slack loop in the wire created by the tightening of the wire, and spring-loaded feed means disposed upstream of the feed means with respect to the bale for dampening motion in the wire upon taking up of the slack loop by continued feeding of the wire. Preferably, the apparatus of the present invention includes a wire magazine for supplying the wire to the feed means. Most preferably, the wire magazine comprises a reel of the wire.

In accordance with one embodiment of the apparatus of the present invention, the spring-loaded feed means is disposed between the feed means and the wire magazine. In a preferred embodiment, the spring-loaded feed means is disposed adjacent to the feed means.

The objects of the present invention are achieved by a resilient device disposed between the feed means and the wire magazine and close to the feed magazine in order to dampen the jerk that occurs when the slack loop of wire runs out and wire starts to be drawn from the magazine.

BRIEF DESCRIPTION OF THE DRAWINGS

The present invention may be more fully appreciated by reference to the following detailed description which, in turn, refers to the drawings, in which.

DETAILED DESCRIPTION

Figure 1:
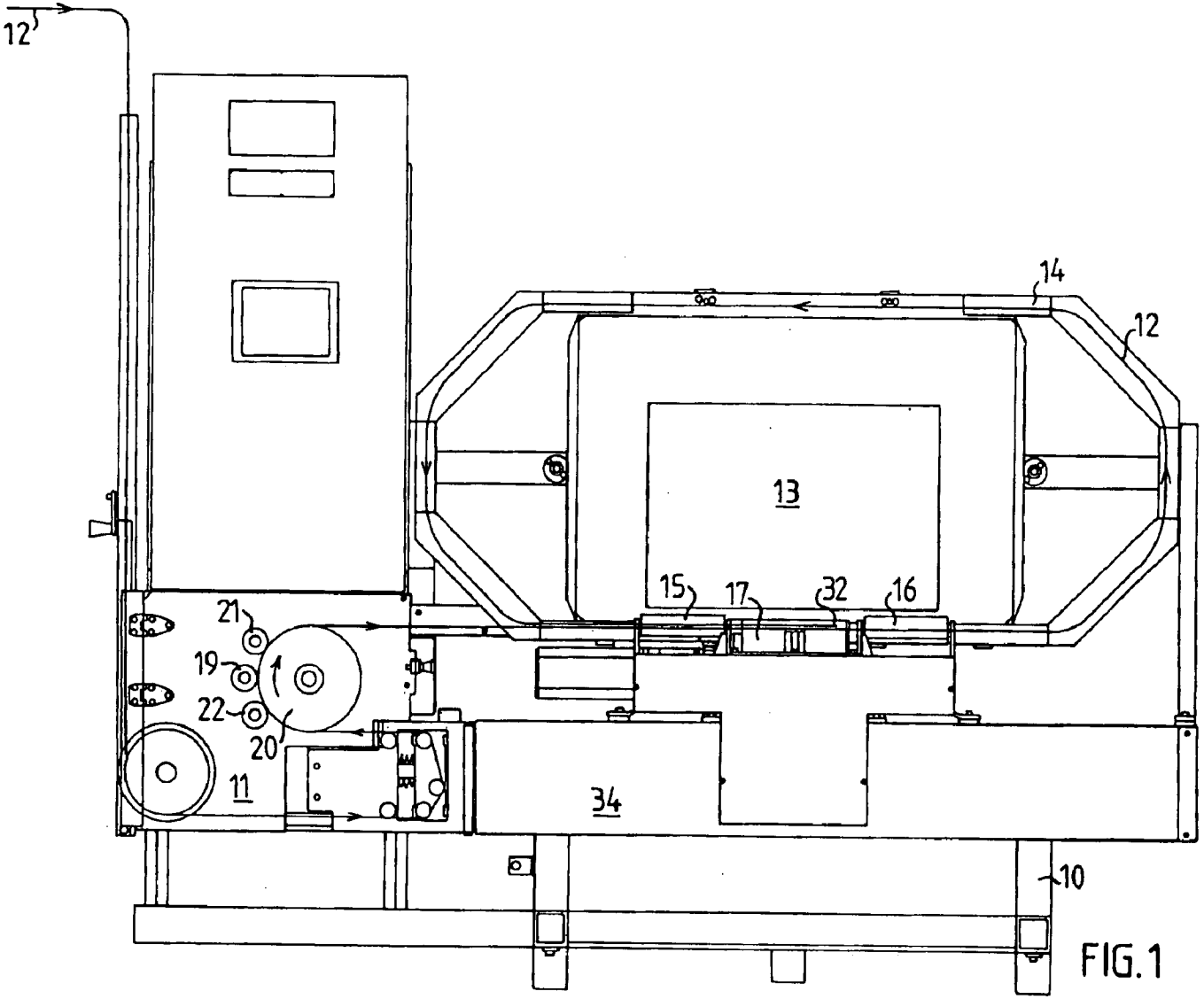
FIG. 1 is a top, elevational, partially cut away view of a binding machine according to the present invention, during forward feeding of the wire.

The binding device shown in the figures has a frame 10 supporting a number of units for different operations. A feed unit 11 is arranged to feed binding wire, which is most commonly steel wire, 12, from a wire magazine (not shown) in the form of a reel from which the wire is unwound. A wire guide means in the form of a rail 14 encircles the pulp bale 13 to be bound. The bale 13 is carried by a bale feed conveyor 15, 16, in a direction perpendicular to the plane of the paper, into the guide rail 14. A binding unit 17 comprises means for cutting the wire, gripping the wire ends and twisting the wire ends. The binding unit is of conventional type and is not shown and described in detail, reference being made to the above-noted patent specifications.

Figure 3:
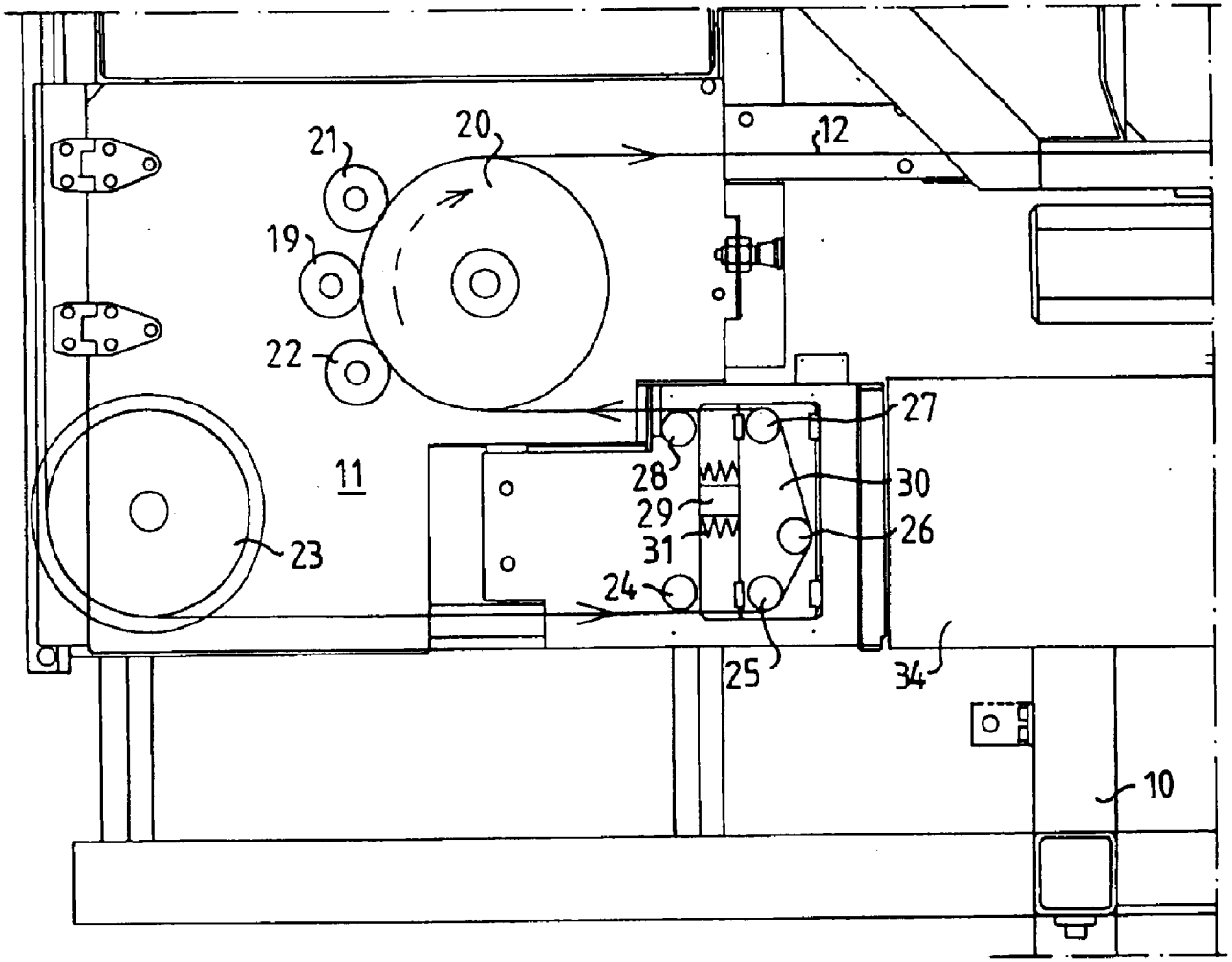
FIG. 3 is a top, elevational, enlarged view of the feed unit of the binding machine shown in FIG. 1.

The feed unit 11 is shown in the figures with a cover plate removed and is shown enlarged in FIG. 3. It comprises a feed pulley 20 driven by a reversible motor (not shown), and the wire 12 is compressed against the feed pulley by pressure rollers, 19, 21, and 22, in order to exert a frictional force on the wire. The wire passes around a change-of-direction pulley 23, by means of a guide pulley 24, around three change-of-direction pulleys 25, 26, and 27, and a guide pulley 28, to a feed pulley 20. The three change-of-direction pulleys, 25 through 27, are mounted upon a block 30 which slides on a guide pin 29 which is fixed relative to the frame, which block is pressed by means of a spring 31 towards an outer end position, the wire tension being opposed to the force of the spring. The force of the spring is appropriately adjusted so that under normal wire tension the block 30 is barely retained in its outer end position. Inasmuch as the tension in the wire gives rise to a resultant force on the block 30 which is parallel to and coaxial, or almost coaxial, with the guided motion of the block, no lateral forces will be acting on the guided motion of the block.

Figure 2:
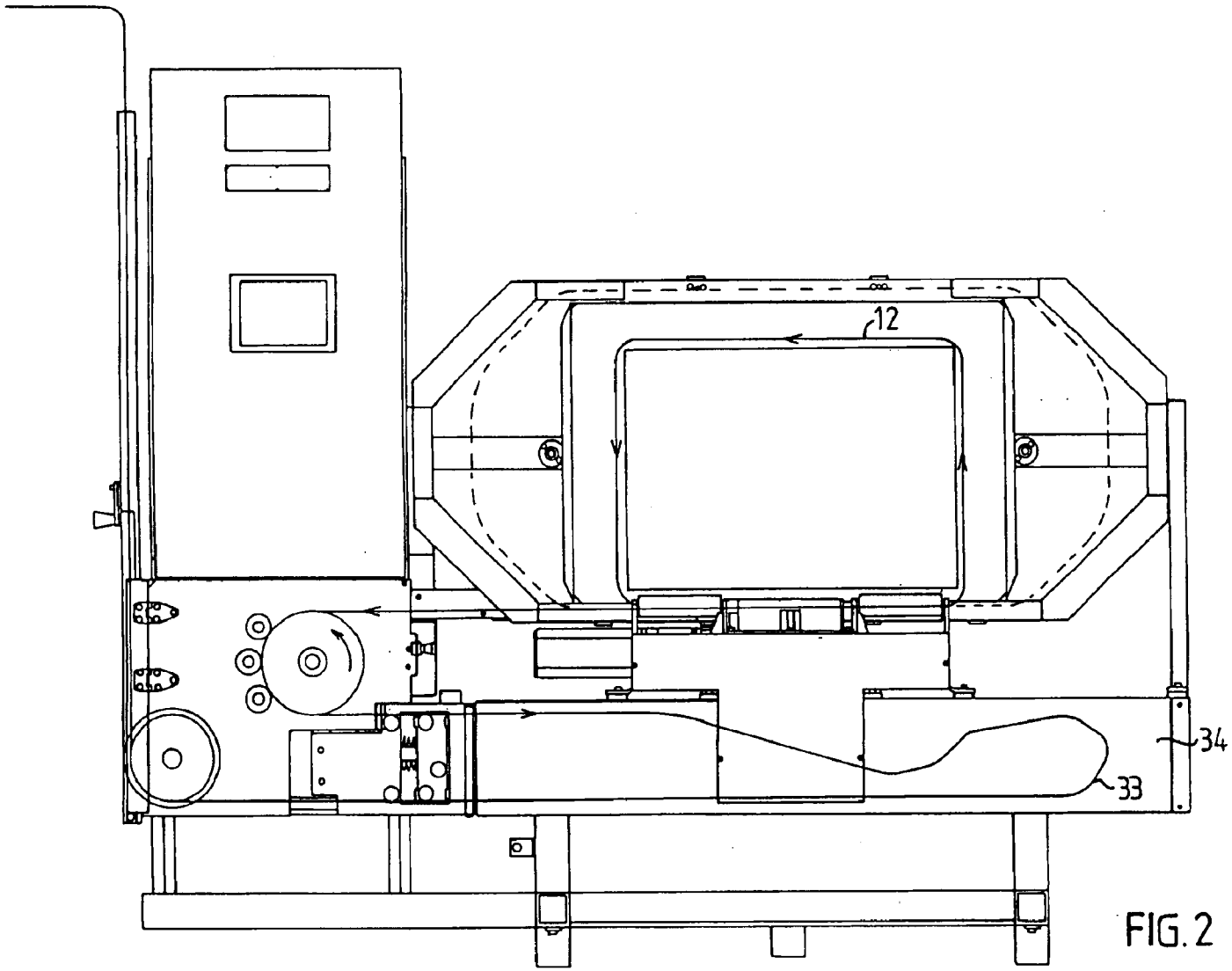
FIG. 2 is a top, elevational, partially cut away view of the binding machine shown in FIG. 1 during tightening of the wire.

FIG. 1 shows the binding device during forward feeding of the wire at a point when the feed pulley 20 has fed the free end 32 of the wire 12 around the bale 13 and the end has been guided by the guide rail 14 back to the binding unit 17. The binding unit 17 then grasps and holds the wire end 32. The wire guide rail 14 is axially split and opens at this time, releasing the wire 12, and when the feed pulley 20 reverses direction, the wire will be tightened around the bale 13 as shown in FIG. 2. When the wire 12 tightens as shown in FIG. 2 the reverse fed wire will form a slack loop 33 in an elongated wire take-up unit 34. When the wire 12 is tightened, the binding unit 17 will cut off the wire and twist the ends to form a knot.

After a wire has been passed around the bale as described, the bale is moved a certain distance forward by the bale conveyor 15, 16 to receive another lap of wire. The feed pulley 20 again begins feeding the wire end, and at first wire is taken from the slack loop 33 left by the preceding reverse feed operation and the feed pulley 20 quickly attains the full feed rate which may be e.g. 4.5 m/s. When the slack runs out and the slack loop reaches the three change-of-direction pulleys, 25–27, mounted on the block 30, the wire will begin to be drawn from the change-of-direction pulley 23 and the stationary wire will begin to accelerate up to the feed rate. The jerk that occurs when the slack loop of wire reaches the change-of-direction pulleys, 25–27, will compress the spring 31, thus damping the jerk in the stationary portion of the wire so that it can accelerate smoothly. The spring should not be pre-stressed and its progressivity should be such that there is time for the force exerted by the wire to brake the return motion of the block so that the block does not stop abruptly in its normal position, as this could cause a risk of kinking and tangling of the wire, even though the motion of the block 30 when the slack loop 33 of wire reaches the three change-of-direction pulleys, 25–27, reduces the risk thereof. The spring-loaded block 30 achieves a considerable reduction in the risk of kinking and tangling of the wire and simultaneously reduces the stress on the feed pulley 20 and on its motor and gearbox if any, which may result in increased lifetime of these parts. Application of the invention permits the use of a very high wire feed rate.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for binding bales with wire comprising feed means for feeding and tightening said wire, a guide for guiding said wire fed by said feed means around said bale, wire processing means for cutting, tightening and twisting the ends of said wire, a take-up unit for taking up a slack loop in said wire created by said tightening of said wire, and a spring assembly disposed upstream of said feed means with respect to said bale for damping motion in said wire upon taking up of said slack loop by continued feeding of said wire;

said spring assembly comprising a wire guide block, a plurality of guide rollers rotatably mounted on said wire guide block, and a spring which applies a force to said wire guide block to urge said wire guide block to a maximum forward position;

wherein the wire has a taut condition in which the wire is in contact with each of said plurality of guide rollers and a slack condition in which the wire is no longer in contact with at least one of said plurality of guide rollers when said guide block is at the maximum forward position.

2. The apparatus of claim 1, further comprising a wire feed pulley, said wire feed pulley rotating in a first direction to place the wire in said taut condition and a second direction to place the wire in said slack condition.

3. The apparatus of claim 2, wherein said wire feed pulley is powered by a reversible motor.

4. The apparatus of claim 2, further comprising at least one pressure roller urging the wire against said wire feed pulley.

5. The apparatus of claim 2, wherein said spring cooperates with said guide block so said guide block is moved against said spring to a minimum forward position upon movement of said wire feed pulley in said first direction to cushion the wire during its transition from said slack condition to said taut condition.

6. The apparatus of claim 5, wherein said wire maintains a feed rate of approximately 4.5 m/s during its transition from said slack condition to said taut condition.

7. The apparatus of claim 5, wherein said plurality of guide rollers comprises three guide rollers, wherein all three of said guide rollers are in contact with the wire when the wire is in the taut condition and less than all of said guide rollers are in contact with the wire when the wire is in the slack condition.

8. The apparatus of claim 5, further comprising a change of direction pulley downstream of said wire guide block, wherein the wire contacting said change of direction pulley is stationary when the wire is in said slack condition.

9. The apparatus of claim 8, wherein the wire remains stationary along said change of direction pulley during the transition from said slack condition to said taut condition.

10. The apparatus of claim 8, wherein the wire remains stationary along said change of direction pulley during the transition from said taut condition to said slack condition.

11. The apparatus of claim 1, further comprising at least one change of direction pulley for altering the direction of travel of the wire.

12. The apparatus of claim 1, wherein said block is slideably mounted on a fixed guide pin and the spring is disposed about said guide pin.

13. The apparatus of claim 5, wherein said block is slideably mounted on a fixed guide pin and the spring is disposed about said guide pin.

14. Apparatus for binding bales with wire comprising feed means for feeding and tightening said wire, a guide for guiding said wire fed by said feed means around said bale, wire processing means for cutting, tightening and twisting the ends of said wire, a take-up unit for taking up a slack loop in said wire created by said tightening of said wire, and a spring assembly disposed along said wire for damping motion in said wire upon taking up of said slack loop by continued feeding of said wire;

said spring assembly comprising a wire guide block, a plurality of guide rollers rotatably mounted on said wire guide block, and a spring which applies a force to said wire guide block to urge said wire guide block to a maximum forward position reached during normal operation of the apparatus;

wherein the wire has a taut condition in which the wire is in contact with each of said plurality of guide rollers and a slack condition in which the wire is no longer in contact with at least one of said plurality of guide rollers when said guide block is at the maximum forward position.

15. Apparatus for binding bales with wire comprising feed means for feeding and tightening said wire, a guide for guiding said wire fed by said feed means around said bale, wire processing means for cutting, tightening and twisting the ends of said wire, a take-up unit for taking up a slack loop in said wire created by said tightening of said wire, and a spring assembly disposed upstream of said feed means with respect to said bale for damping motion in said wire upon taking up of said slack loop by continued feeding of said wire;

said spring assembly comprising a wire guide block, a plurality of rollers rotatably mounted on said wire guide block, and a spring which applies a force to said wire guide block to urge said wire guide block to a maximum forward position reached during normal operation of the apparatus;

wherein the wire has a taut condition in which the wire is in contact with at least one roller of said plurality of rollers and a slack condition in which the wire is completely removed from said at least one roller and a portion of said wire is stationary.

16. Apparatus for binding bales with wire comprising feed means for feeding and tightening said wire, a guide for guiding said wire fed by said feed means around said bale, wire processing means for cutting, tightening and twisting the ends of said wire, a take-up unit for taking up a slack loop in said wire created by said tightening of said wire, and a spring assembly disposed upstream of said feed means with respect to said bale for damping motion in said wire upon taking up of said slack loop by continued feeding of said wire;

said spring assembly comprising a wire guide block, a plurality of guide rollers rotatably mounted on said wire guide block, and a spring which applies a force to said wire guide block to urge said wire guide block to a maximum forward position reach by pressing of said spring against said guide black;

wherein the wire has a taut condition in which the wire is in contact with at least one roller of said plurality of guide rollers and a slack condition in which the wire is no longer in contact with at least one of said plurality of guide rollers when said guide block is at the maximum forward position.

* * * * *

UNITED STATES PATENT AND TRADEMARK OFFICE

CERTIFICATE OF CORRECTION

PATENT NO. : 6,877,421 B2
DATED : April 12, 2005
INVENTOR(S) : Fahredin Rexhaj

It is certified that error appears in the above-identified patent and that said Letters Patent is hereby corrected as shown below:

Column 2,
Lines 1 and 4, “cut away” should read -- cut-away --.

Column 6,
Line 3, “reach” should read -- reached --.
Line 4, “black” should read -- block --.

Signed and Sealed this

Nineteenth Day of July, 2005

JON W. DUDAS
*Director of the United States Patent and Trademark Office*